United States Patent [19]

Guhde

[11] 4,351,675

[45] Sep. 28, 1982

[54] CONVERSION COATINGS FOR ZINC AND CADMIUM SURFACES

[75] Inventor: Donald J. Guhde, Euclid, Ohio

[73] Assignee: ROHCO, Inc., Cleveland, Ohio

[21] Appl. No.: 239,331

[22] Filed: Mar. 2, 1981

[51] Int. Cl.[3] ..... C23F 7/08

[52] U.S. Cl. ..... 148/6.15 R; 148/6.17

[58] Field of Search ..... 148/6.17, 6.15 R

[56] References Cited

U.S. PATENT DOCUMENTS

| | | | |
|---|---|---|---|
| 3,663,441 | 5/1972 | Gulla . | |
| 3,668,131 | 6/1972 | Banush et al. . | |
| 4,075,066 | 2/1978 | Eckles et al. . | |
| 4,158,592 | 6/1979 | Readio et al. . | |
| 4,162,947 | 7/1979 | Canaris . | |
| 4,169,772 | 10/1979 | Lowery et al. . | |
| 4,171,231 | 10/1979 | Bishop et al. . | |
| 4,222,779 | 9/1980 | Bengali et al. | 148/6.17 |
| 4,225,350 | 9/1980 | Allan | 148/6.17 |
| 4,225,351 | 9/1980 | Zuendt | 148/6.17 |
| 4,229,268 | 10/1980 | Lowery et al. . | |

*Primary Examiner*—Ralph S. Kendall

*Attorney, Agent, or Firm*—Maky, Renner, Otto & Boisselle

[57] ABSTRACT

An aqueous acidic coating solution for treating zinc, zinc alloy or cadmium surface comprising (A) an oxidizing agent selected from the group consisting of hydrogen peroxide, nitrate ion, nitrite ion, halate ion or mixtures thereof, and (B) a compound having the formula

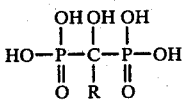

wherein R is hydrogen or an alkyl group of from 1 to 4 carbon atoms.

34 Claims, No Drawings

CONVERSION COATINGS FOR ZINC AND CADMIUM SURFACES

TECHNICAL FIELD

This invention relates generally to conversion coatings for zinc, zinc alloy and cadmium surfaces and, more particularly, to novel aqueous acidic coating solutions comprising an oxidizing agent and an organophosphorus promoter. The invention also relates to a method for depositing such coatings on zinc, zinc alloy and cadmium surfaces and to metal articles having zinc, zinc alloy or cadmium surfaces which are coated with such solutions.

BACKGROUND OF THE INVENTION

Various conversion coatings on metal surfaces have been suggested in the prior art for the purpose of forming a coating which protects the metal against corrosion and also serves as a base for improving the adhesion of subsequently applied siccative organic finishes. Such conversion coatings are applied by treatment of the surfaces with solutions of various chemicals which react with the surface to form the desired coating. Among the commonly used conversion coating compositions are aqueous phosphate and chromate solutions. Among the simplest of the phosphate compositions are the so-called iron phosphates which comprise, for example, solutions of alkali metal phosphates, and which react with the iron on the metal surface to form an iron phosphate coating.

It has long been known that surfaces of zinc and zinc-based alloys can be protected against corrosion by treatment with an acid solution containing hexavalent chromium. It was suggested that the attack of the solution on the surface is facilitated if the solution initially contained a small amount of trivalent chromium, and it has been proposed to introduce this trivalent chromium by adding a compound of trivalent chromium or preferably by adding a small amount of a suitable reducing agent. As the solutions are used, more trivalent chromium is formed by reduction of hexavalent chromium at the zinc surfaces so that the concentration of trivalent chromium progressively increases and the solution eventually has to be discarded when the quality of the coating is affected by the deterioration of the solution. Examples of patents which describe solutions containing mixtures of trivalent chromium and hexavalent chromium include U.S. Pat. Nos. 3,880,772; 3,795,549; 3,553,034; 3,404,046; 3,090,710; 2,911,332; and 2,902,392. The treatment of zinc surfaces with solutions wherein chromium is entirely in a trivalent state is disclosed in U.S. Pat. Nos. 4,171,231; 3,932,198; 3,647,569; 3,501,352; and 2,559,878. Trivalent chromium solutions are also disclosed in British Patent 1,461,244.

The prior art chromium solutions and the coatings obtained therefrom have not been entirely satisfactory in that they have not always been able to meet the requirements of the zinc plating industry. One of the important requirements of the chromium-containing solution is the ability of the solution to impart a clear to light blue finish on the zinc or zinc alloy surface. In the past, the achievement of this finish on zinc plated from a cyanide containing solution was a relatively easy process using conventional chromates containing hexavalent chromium compounds sometimes in combination with other species such as nitrates, fluorides, sulfates, etc. However, with the advent of alkaline non-cyanide type zinc plating solutions, the production of the proper finish of the zinc after chromating has been a difficult procedure. The difficulties generally have been thought to result from the co-deposition and inclusion of relatively large amounts of organic materials from the zinc brightener components.

Another problem area in chromating is that of iron contamination of the plating bath which causes black staining of the zinc plate when chromated. This problem frequently is encountered in alkaline non-cyanide baths that have been converted from cyanide containing baths. Cyanide baths generally contain relatively large amounts of complexed iron in the form of ferrocyanides. When the free cyanide concentration of the bath reaches approximately zero, these ferrocyanides begin to decompose during electrolysis, and iron is codeposited in the zinc deposit. This problem also can occur in non-cyanide zinc baths which utilize strong chelating or complexing agents as part of the additive system. The source of iron in this case generally is from drag-in of dissolved iron from the preceding acid pickling tanks. The iron staining problem is most frequently encountered in acid zinc plating baths where the pH is low enough that iron can be dissolved in the bath either from non-plated areas of the parts being processed or from parts laying in the bottom of the plating tank. The generally accepted explanation for the black staining is that the hexavalent chromium compounds used in conventional chromates react with codeposited iron to form black iron oxides.

Another disadvantage of hexavalent chromium type solutions is in the area of waste disposal. Recent emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive. Another problem which has been observed with chromate finishes which have been described previously is the unacceptable adhesion characteristics when certain paints have been applied over the chromate coatings, particularly on exposure to salt spray.

Non-chromate conversion coating solutions are disclosed, for example, in U.S. Pat. Nos. 4,225,351; 4,225,350 and 4,222,779 for the treatment of zinc, cadmium, silver, copper, aluminum, magnesium and zinc alloys. Each of these patents discloses a bath constituted of an aqueous solution of from about 0.2 to about 45 grams per liter of free $H_2SO_4$, from about 1.5 to about 58 grams per liter of $H_2O_2$, from about 3 to about 33 grams per liter of $SiO_2$ and from about 0.15 to about 10 grams per liter of an organophosphorus promoter. In each of these patents, the preferred organophosphorus promoter is 1-hydroxyethylidene-1,1-diphosphonic acid. U.S. Pat. No. 4,225,351 provides for the addition of a secondary promoter selected from the group consisting of ascorbic acid, boric acid, gluconic acid, glycolic acid, tartaric acid and the salts of these acids to the foregoing solution. U.S. Pat. No. 4,225,350 discloses the addition of a cationic triarylmethane dye to this solution. A disadvantage of using the non-chromate solutions disclosed in the foregoing patents is the tendency of these solutions to gel after a relatively shortened period. This tendency to gel not only limits the useful life of the bath but also prohibits the effective use of providing concentrates for starting or maintaining baths of these solutions.

It would be advantageous to provide a non-chromate conversion coating for use with zinc, zinc alloy and cadmium surfaces from a solution that was stable over a relatively indefinite period of time and could be started and maintained with concentrates.

SUMMARY OF THE INVENTION

It has now been discovered that a non-chromate containing coating bath for the treatment of zinc, zinc alloy and cadmium surfaces that is stable over a relatively indefinite period of time and can be started and/or maintained with concentrates can be effected by the utilization of the coating solution hereinafter described. Broadly stated, the present invention contemplates the provision of an aqueous acidic coating solution for treating a zinc, zinc alloy or cadmium surface comprising (A) an oxidizing agent selected from the group consisting of nitrate ion, nitrite ion, halate ion, hydrogen peroxide or mixtures thereof, and (B) an organophosphorus promoter. In a preferred embodiment, the foregoing solution contains (C) $SiO_2$. Advantageously, the foregoing solution contains an effective amount of nitric acid to regulate the pH of the solution between about 1 and about 4. The present invention further contemplates a method of producing a conversion coating on zinc, zinc alloy or cadmium surface which comprises contacting said surface with the foregoing aqueous acidic coating solution. The present invention further contemplates an article having a zinc, zinc alloy or cadmium surface treated with the foregoing aqueous acidic coating solution.

DESCRIPTION OF THE PREFERRED EMBODIMENTS

The aqueous acidic coating solutions of the present invention which are useful for treating zinc, zinc alloy or cadmium surfaces comprise a mixture of (A) nitrate ion, nitrite ion, halate ion, hydrogen peroxide or mixtures thereof, and (B) an organophosphorus promoter. It will be understood by those skilled in the art that the aqueous acidic coating solutions of the present invention may or may not be true solutions, but rather may be in the form of hydrosols; for the purposes of this specification and the appended claims, it will be understood that the term "solution" is intended to cover hydrosols as well as true solutions.

As a source of nitrate ions, alkali metal nitrate, alkaline-earth metal nitrate, aluminum nitrate, zinc nitrate or ammonium nitrate salts, for example, may be used. Sodium and potassium are the preferred alkali metals and calcium is the preferred alkaline-earth metal. The aluminum nitrate can be in the form of any of the states of hydration at which aluminum nitrate is generally available. Aluminum nitrate nonahydrate is particularly advantageous because of its generally preferred characteristics of stability over the other hydrated forms. Zinc nitrate can be employed in any generally available form; zinc nitrate hexahydrate is particularly suitable for use with the coating solution of the invention. Nitrate ions are present in the coating solution of the invention at a concentration in the range of about 1 to about 50 grams per liter, preferably about 3 to about 20 grams per liter. Mixtures of the foregoing nitrate salts can be employed in accordance with the present invention, the level of addition of salts for such mixtures should be such to provide a total nitrate ion concentration within the foregoing ranges.

As a source of nitrite ions, the salts of alkali metal nitrite, for example, are preferred. Sodium nitrite and potassium nitrite are the preferred alkali metal nitrite salts. Nitrite ions are provided in the solution of the invention at a concentration in the range of, preferably, about 0.5 to about 2 grams per liter.

As a source of halate ions, alkali halate metal salts, for example, may be used. The preferred halate ions are chlorate, bromate, and iodate. The preferred alkali metals are sodium and potassium. Sodium bromate is particularly suited for use with the solution of the invention. The halate ions are provided in the solution of the invention at a concentration in the range of about 0.5 to about 20 grams per liter.

Hydrogen peroxide is provided in the coating solution of the invention at a concentration level in the range of about 0.5 to about 20 grams per liter, preferably about 2 to about 8 grams per liter. It is particularly advantageous to provide hydrogen peroxide in the form of an aqueous solution, the concentration of such solution being, for example, about 35% hydrogen peroxide.

Mixtures of the foregoing ions can also be employed in the solution of the invention. When such mixtures are employed, the concentration of each of the ions will generally be less than if they are used separately, but the concentration for each of the ions in such mixtures should generally be within the foregoing concentration ranges.

Component (B) which is a promoter for enhancing formation of the conversion coating is a compound having the formula

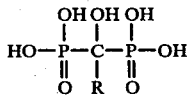

wherein R is hydrogen or an alkyl group of from 1 to 4 carbon atoms. The preferred compound is 1-hydroxyethylidene-1,1-diphosphonic acid which is commercially available from the Monsanto Company under the trade designation "Dequest 2010". Dequest 2010 is identified as having an active content of 58 to 62%. Component (B) is present in the solution of the present invention at a concentration in the range of about 0.5 to about 10 grams per liter, preferably about 1 to about 4 grams per liter.

Component (C) can be any form of $SiO_2$ wherein the average particle size of the silica upon introduction into said solution is in the range of about 0.004 to about 0.120 microns, preferably about 0.004 to about 0.060 microns. In a particularly advantageous embodiment the particle size is in the range of about 0.004 to about 0.020 microns. $SiO_2$ provided in the form of a colloidal dispersion of fumed silica has been found to be of particular advantage for use in preparing and maintaining the solution of the invention. $SiO_2$ is present in the solution of the invention at a concentration in the range of about 1 to about 40 grams per liter of $SiO_2$, preferably about 5 to about 15 grams per liter of $SiO_2$. Colloidal dispersions that are suitable for use with the solution of the present invention are available, for example, from the Cabot Corporation under the trade designations "Cab- O-Grip II" and "Cab-O-Sperse" and from Nalco Chemical Company under the general trade designation "Nalcoag".

A preferred aqueous acidic conversion coating solution employed in accordance with the invention comprises from about 0.5 to about 70 grams per liter, preferably about 7.5 to about 15 grams per liter, of aluminum nitrate; from about 0.5 to about 10 grams per liter of 1-hydroxyethylidene-1,1-diphosphonic acid; and an effective amount of nitric acid to provide a pH for said solution of between about 1 and about 4. Another preferred aqueous acidic conversion coating solution that is provided in accordance with the invention comprises from about 1 to about 50 grams per liter, preferably about 5 to about 15 grams per liter, of sodium nitrate or potassium nitrate; from about 0.5 to about 10 grams per liter of 1-hydroxyethylidene-1,1-diphosphonic acid; and an effective amount of nitric acid to provide a pH level in the range of about 1 to about 4. Another preferred coating solution that is provided in accordance with the invention comprises from about 0.5 to about 70 grams per liter, preferably about 7.5 to about 15 grams per liter, of aluminum nitrate; from about 1 to about 50 grams per liter, preferably about 5 to about 15 grams per liter, of sodium nitrate or potassium nitrate; from about 0.5 to about 10 grams per liter of 1-hydroxyethylidene-1,1-diphosphonic acid; and an effective amount of nitric acid to provide a pH for said solution in the range of about 1 to about 4. With either of the foregoing preferred solutions, $SiO_2$ is advantageously added at a concentration level in the range of about 1 to about 40 grams per liter of $SiO_2$, said $SiO_2$ having an average particle size upon introduction into said solution in the range of about 0.004 to about 0.120 microns.

In another preferred embodiment of the present invention, nitrobenzenesulfonate is combined with component (B), as defined above, for providing a solution for coating zinc, zinc alloy or cadmium surfaces. The level of addition of nitrobenzenesulfonate depends on the desired depth of color to be provided for the metal surface. Concentration levels for the nitrobenzenesulfonate in the range, for example, of about 1 to about 10 grams per liter are preferred. In a particularly advantageous embodiment, sodium m-nitrobenzenesulfonate is employed. The levels of addition of component (B) are the same as discussed above.

As a particular feature of the present invention, any conventional conversion coating dye can be added to the solution to provide desired color. The amount of dye to be added to the solution depends on the desired depth of color. Conversion coating dyes are well known to those of ordinary skill in the art and, accordingly, need not be further described herein. Examples of commercially available conversion coating dyes that are suitable for use with the coating solution of the invention include, for example, Chromate Blue #1, Chromate Black #1 and Omega Chrome Cyanine GR, all of which are products of Sandoz Colors and Chemicals.

In another aspect of the invention, sodium bifluoride is added to the solution of the invention to provide thicker and bluer coatings. The level of addition is dependent on the depth of color desired. Generally the level of sodium bifluoride will range, for example, from about 0.1 to about 3 grams per liter.

In the coating operation in which the method of the present invention is used, the zinc or cadmium surface usually is first cleaned by chemical and/or physical means to remove any grease, dirt or oxides, although such treatments are not always required. After rinsing the surface with water, the zinc or cadmium surface then is treated with the aqueous acidic coating solution of the invention. Treatment may be by any of the commonly used techniques such as spraying, brushing, dipping, roller coating, reverse-roller coating and flow coating. The coating solutions of the invention are particularly useful in a dipping system.

The pH of the coating solutions of the invention during application generally is from about 1 to about 4, preferably from about 1.5 to about 2. An effective amount of nitric acid can be added to the solution to adjust the pH to the desired level.

During the course of the coating process, the coating solution becomes depleted and, therefore, must be replenished. Baths employing the solution of the invention can be maintained by monitoring the pH of the solution. When the pH rises above a desired level, a suitable amount of an aqueous acidic additive composition or concentrate can be added to replenish the bath and thereby return the pH to the desired level. These additive concentrates are constituted primarily of the ions of components (A) and (B) employed in the solution. These concentrates also preferably include water and an effective amount of nitric acid to restore the pH of the solution to the desired level. Sodium bifluoride can also be provided with these concentrates. These concentrates can be used in the initial preparation of baths employing solutions of the invention. The following examples illustrate additive concentrates which may be prepared and utilized in accordance with the invention for preparing, maintaining and/or replenishing the baths employing the solutions of the invention and/or improving the performance of such baths.

| | Parts by Weight |
|---|---|
| Concentrate No. 1 | |
| Water | 79 |
| Aluminum Nitrate Nonahydrate | 8.5 |
| Dequest 2010 | 2.5 |
| 70% Nitric Acid | 10 |
| Concentrate No. 2 | |
| Water | 81.8 |
| Sodium Nitrate | 5.7 |
| Dequest 2010 | 2.5 |
| 70% Nitric Acid | 10 |
| Concentrate No. 3 | |
| Water | 60 |
| Sodium Nitrate | 11.4 |
| Dequest 2010 | 5 |
| 67% Nitric Acid | 20.6 |
| Sodium bifluoride | 3 |

In preparing a bath solution in accordance with the present invention, the foregoing concentrates can be diluted, for example, by 24 parts by volume of water per part by volume of concentrate. An effective amount of nitric acid or a suitable alkaline material (e.g., sodium hydroxide) can be added to the bath to adjust the pH of the bath to a level in the range of about 1 to about 4. An effective amount of $SiO_2$ in the form of, for example, Cab-O-Sperse, Cab-O-Grip II or Nalcoag can be added (if $SiO_2$ is employed in the bath solution) to the bath with any of the foregoing concentrates to adjust the level of $SiO_2$ to a desired level. The terms "Concentrate No. 1" and "Concentrate No. 2" used in the specific examples below refer to the above identified concentrates.

The temperature of application of the coating solution to the metal surface usually is between about 10° C. to about 50° C., preferably between about 20° C. and about 35° C. When the method of application is by dipping or immersion, a dipping or immersion time of about 15 seconds to about 1 minute is utilized. If additional time is required in order to obtain the desired finish, this is an indication that the coating composition needs to be replenished.

Following treatment with the solution of the invention, the metal surface may be rinsed with water, usually also at a temperature below about 50° C. and then dried. Drying may be by air blowing at room temperature or at a higher temperature, for example, 120° C. to 150° C.

The conversion coating produced on the zinc or cadmium surfaces in accordance with the method of the invention is a clear or blue-white finishing color. In addition to furnishing an attractive appearance to the metal, the coatings of the invention provide improved corrosion resistance and paint adhesion.

By way of further illustration of the invention, reference may be made to the following specific examples. In the following Examples 1 to 19 freshly plated zinc panels are immersed in an aqueous solution containing 2.5 mililiters per liter of 70% nitric acid for 10 seconds and then immersed in the indicated aqueous, acidic coating solution for about 15 to 30 seconds whereupon a coating with a clear or white-blue appearance is formed. In each instance an effective amount of nitric acid is added to the coating solution to obtain the indicated level of pH. The panels are removed from the solution, rinsed with water and allowed to dry in air over a period of about 24 hours at room temperature. The dried panels are subjected to a 5% neutral salt spray environment for the indicated number of hours with the results indicated as the percentage of surface area free of white rust measured by visual inspection.

| Example | Solution Contents | Component Concentration | pH of Solution | Corrosion Resistance |
|---|---|---|---|---|
| 1 | $Al(NO_3)_3\ 9H_2O$ | 15 g/l | 1.5 | 97–100% at 7 hrs. |
| | Dequest 2010 | 2.2 g/l | | 90–93% at 31 hrs. |
| | Cab-O-Sperse* | 70 g/l | | |
| 2 | $Al(NO_3)_3\ 9H_2O$ | 35 g/l | 1.4 | 99% at 7 hrs. |
| | Dequest 2010 | 2.2 g/l | | |
| | Cab-O-Sperse | 70 g/l | | |
| 3 | $Al(NO_3)_3\ 9H_2O$ | 70 g/l | 1.65 | 89% at 31 hrs. |
| | Dequest 2010 | 2.2 g/l | | |
| | Cab-O-Sperse | 70 g/l | | |
| 4 | $Al(NO_3)_3\ 9H_2O$ | 70 g/l | 2.0 | 90% at 7 hrs. |
| | Dequest 2010 | 2.2 g/l | | |
| | Cab-O-Sperse | 70 g/l | | |
| | 35% $H_2O_2$ Aq. Sol'n. | 20 ml/l | | |
| 5 | $Al(NO_3)_3\ 9H_2O$ | 15 g/l | 2.0 | 100% at 7 hrs. |
| | Dequest 2010 | 2.2 g/l | | 88–90% at 31 hrs. |
| | Cab-O-Sperse | 70 g/l | | |
| 6 | $Al(NO_3)_3\ 9H_2O$ | 15 g/l | 1.5 | 100% at 7 hrs. |
| | Dequest 2010 | 2.2 g/l | | 93% at 31 hrs. |
| | Cab-O-Grip | 52.5 g/l | | |
| 7 | $Al(NO_3)_3\ 9H_2O$ | 15 g/l | 2.0 | 100% at 7 hrs. |
| | Dequest 2010 | 2.2 g/l | | 88–90% at 31 hrs. |
| | Cab-O-Grip | 52.5 g/l | | |
| 8 | $Al(NO_3)_3\ 9H_2O$ | 15 g/l | 2.0 | 100% at 7 hrs. |
| | Dequest 2010 | 4.0 g/l | | |
| | Cab-O-Sperse | 70 g/l | | |
| 9 | $Al(NO_3)_3\ 9H_2O$ | 7.5 g/l | 2.0 | 85% at 24 hrs. |
| | Dequest 2010 | 2.2 g/l | | |
| | Cab-O-Sperse | 70 g/l | | |
| 10 | $Al(NO_3)_3\ 9H_2O$ | 15 g/l | 2.0 | 94% at 24 hrs. |

-continued

| Example | Solution Contents | Component Concentration | pH of Solution | Corrosion Resistance |
|---|---|---|---|---|
| | Dequest 2010 | 2.2 g/l | | |
| | Cab-O-Sperse | 70 g/l | | |
| | $NaNO_3$ | 5 g/l | | |
| 11 | $Al(NO_3)_3\ 9H_2O$ | 15 g/l | 2.0 | 85% at 24 hrs. |
| | Dequest 2010 | 2.2 g/l | | |
| | Cab-O-Sperse | 70 g/l | | |
| | $NaNO_3$ | 10 g/l | | |
| 12 | $Al(NO_3)_3\ 9H_2O$ | 15 g/l | 2.0 | 91% at 24 hrs. |
| | Dequest 2010 | 2.2 g/l | | |
| | Cab-O-Sperse | 70 g/l | | |
| | $NaNO_3$ | 15 g/l | | |
| 13 | $Al(NO_3)_3\ 9H_2O$ | 15 g/l | 2.0 | 91% at 24 hrs. |
| | Dequest 2010 | 2.2 g/l | | |
| | Cab-O-Sperse | 70 g/l | | |
| | $NaNO_3$ | 20 g/l | | |
| 14 | $NaNO_3$ | 5 g/l | 2.0 | 95% at 24 hrs. |
| | Dequest 2010 | 2.2 g/l | | |
| | Cab-O-Sperse | 70 g/l | | |
| 15 | $NaNO_3$ | 10 g/l | 2.0 | 96% at 24 hrs. |
| | Dequest 2010 | 2.2 g/l | | |
| | Cab-O-Sperse | 70 g/l | | |
| 16 | $Al(NO_3)_3\ 9H_2O$ | 15 g/l | 1.5 | 99% at 7 hrs. |
| | Dequest 2010 | 2.2 g/l | | 82% at 31 hrs. |
| | Cab-O-Sperse | 70 g/l | | |
| | Chromate Blue #1 | 0.1 g/l | | |
| 17 | $Al(NO_3)_3\ 9H_2O$ | 15 g/l | 2.0 | 97% at 7 hrs. |
| | Dequest 2010 | 2.2 g/l | | 85% at 31 hrs. |
| | Cab-O-Sperse | 70 g/l | | |
| | Chromate Blue #1 | 0.1 g/l | | |
| 18 | $Al(NO_3)_3\ 9H_2O$ | 15 g/l | 1.5 | 100% at 7 hrs. |
| | Dequest 2010 | 2.2 g/l | | 82% at 31 hrs. |
| | Cab-O-Sperse | 70 g/l | | |
| | Omega Chrome Cyanine GR | 0.1 g/l | | |
| 19 | $Al(NO_3)_3\ 9H_2O$ | 15 g/l | 2.0 | 99% at 7 hrs. |
| | Dequest 2010 | 2.2 g/l | | 85% at 31 hrs. |
| | Cab-O-Sperse | 70 g/l | | |
| | Omega Chrome Cyanine GR | 0.1 g/l | | |

*Cab-O-Sperse is identified as a 15% solids dispersion of Cab-O-Sil M-5. Cab-O-Sil M-5 is a product of Cabot Corporation identified as a synthetic, colloidal amorphous silica having an average particle diameter of 0.014 microns.

The following Examples 20 to 23 are run under the same conditions as the foregoing Examples 1 to 19 with the exception that the panels are dried at a temperature of about 150° C. for 5 minutes rather than at room temperature.

| Example | Solution Contents | Component Concentration | pH of Bath | Corrosion Resistance |
|---|---|---|---|---|
| 20 | $Al(NO_3)_3\ 9H_2O$ | 70 g/l | 2.0 | 90–93% at 7 hrs. |
| | Dequest 2010 | 2.2 g/l | | 52–80% at 31 hrs. |
| | Cab-O-Sperse | 70 g/l | | |
| | 35% $H_2O_2$ Aq. Sol'n. | 20 ml/l | | |
| 21 | $Al(NO_3)_3\ 9H_2O$ | 70 g/l | 2.0 | 93% at 7 hrs. |
| | Dequest 2010 | 2.2 g/l | | 85% at 31 hrs. |
| | Cab-O-Sperse | 70 g/l | | |
| 22 | $Al(NO_3)_3\ 9H_2O$ | 15 g/l | 2.0 | 97% at 7 hrs. |
| | Dequest 2010 | 2.2 g/l | | 70% at 31 hrs. |
| | Cab-O-Sperse | 70 g/l | | |
| | Chromate Blue #1 | 0.1 g/l | | |
| 23 | $Al(NO_3)_3\ 9H_2O$ | 15 g/l | 2.0 | 100% at 7 hrs. |
| | Dequest 2010 | 2.2 g/l | | 85% at 31 hrs. |
| | Cab-O-Sperse | 70 g/l | | |
| | Omega Chrome Cyanine GR | 0.1 g/l | | |

In the following Examples 24 to 47, freshly plated zinc panels are immersed in an aqueous solution containing 2.5 mililiters per liter of 70% nitric acid for about 10 seconds and then immersed in the indicated aqueous acidic coating solution for about 15–30 seconds whereupon a coating with a clear or white-blue appearance is formed. In each instance, either Concentrate No. 1 or No. 2, identified above, is used to prepare the solution. An effective amount of nitric acid is added to the coating solution to obtain the indicated level of pH. The panels are removed from the solution, rinsed with water and allowed to dry for a period of about 24 hours at room temperature. The dried panels are subjected to a 5% neutral salt spray environment for the indicated number of hours with the results indicated as the percentage of surface area free of white rust measured by visual inspection.

| Example | Solution Contents | Component Concentration | pH of Solution | Corrosion Resistance |
|---|---|---|---|---|
| 24 | Concentrate No. 1 | 81 g/l | 2.0 | 79% at 24 hrs. |
| 25 | Concentrate No. 2 | 81 g/l | 2.0 | 88% at 24 hrs. |
| 26 | Concentrate No. 1 | 81 g/l | 2.0 | 67% at 24 hrs. |
| | Cab-O-Grip II* | 1 g/l | | |
| 27 | Concentrate No. 2 | 81 g/l | 2.0 | 85% at 24 hrs. |
| | Cab-O-Grip II | 1.0 g/l | | |
| 28 | Concentrate No. 1 | 81 g/l | 2.0 | 67% at 24 hrs. |
| | Cab-O-Grip II | 2.0 g/l | | |
| 29 | Concentrate No. 2 | 81 g/l | 2.0 | 88% at 24 hrs. |
| | Cab-O-Grip II | 2.0 g/l | | |
| 30 | Concentrate No. 1 | 81 g/l | 2.0 | 79% at 24 hrs. |
| | Cab-O-Grip II | 5.0 g/l | | |
| 31 | Concentrate No. 2 | 81 g/l | 2.0 | 88% at 24 hrs. |
| | Cab-O-Grip II | 5.0 g/l | | |
| 32 | Concentrate No. 1 | 81 g/l | 2.0 | 82% at 24 hrs. |
| | Cab-O-Grip II | 10.0 g/l | | |
| 33 | Concentrate No. 2 | 81 g/l | 2.0 | 94% at 24 hrs. |
| | Cab-O-Grip II | 10.0 g/l | | |
| 34 | Concentrate No. 1 | 81 g/l | 2.0 | 85% at 24 hrs. |
| | Cab-O-Grip II | 25.0 g/l | | |
| 35 | Concentrate No. 2 | 81 g/l | 2.0 | 94% at 24 hrs. |
| | Cab-O-Grip II | 25.0 g/l | | |
| 36 | Concentrate No. 1 | 81 g/l | 2.0 | 85% at 24 hrs. |
| | Cab-O-Grip II | 50.0 g/l | | |
| 37 | Concentrate No. 2 | 81 g/l | 2.0 | 97% at 24 hrs. |
| | Cab-O-Grip II | 50.0 g/l | | |
| 38 | Concentrate No. 2 | 81 g/l | 2.0 | 98% at 24 hrs. |
| | Cab-O-Grip II | 100 g/l | | |
| 39 | Concentrate No. 1 | 81 g/l | 2.0 | 97% at 24 hrs. |
| | Nalcoag 2326** | 72.4 g/l | | |
| 40 | Concentrate No. 1 | 81 g/l | 2.0 | 94% at 24 hrs. |
| | Cab-O-Grip II | 52.5 g/l | | |
| 41 | Concentrate No. 1 | 81 g/l | 2.0 | 88% at 24 hrs. |
| | Nalcoag 2326 | 26.3 g/l | | |
| 42 | Concentrate No. 1 | 81 g/l | 2.0 | 79% at 24 hrs. |
| | Nalcoag 1060*** | 21.0 g/l | | |
| 43 | Concentrate No. 1 | 81 g/l | 2.0 | 76% at 24 hrs. |
| | Cab-O-Grip II | 52.5 g/l | | |
| | Chromate Blue No. 1 | 0.1 g/l | | |
| 44 | Concentrate No. 2 | 81 g/l | 2.0 | 98% at 24 hrs. |
| | Cab-O-Grip II | 52.5 g/l | | |
| 45 | Concentrate No. 2 | 81 g/l | 2.0 | 97% at 24 hrs. |
| | Cab-O-Grip II | 52.5 g/l | | |
| | Chromate Blue No. 1 | 0.1 g/l | | |
| 46 | Concentrate No. 2 | 81 g/l | 2.0 | 97% at 24 hrs. |
| | Cab-O-Grip II | 52.5 g/l | | |
| | Chromate Black No. 1 | 0.3 g/l | | |
| 47 | Concentrate No. 1 | 81 g/l | 2.0 | 87% at 24 hrs. |
| | Nalcoag 2326 | 72.4 g/l | | |
| | Chromate Black No. 1 | 0.1 g/l | | |

*Cab-O-Grip II is a product of Cabot Corporation identified as an aqueous suspension of fumed silicon dioxide having average particle size of primary particles in the range of 0.010 to 0.015 microns and a solids content of 20% by weight.

**Nalcoag 2326 is a product of Nalco Chemical Company identified as a dispersion of $SiO_2$ particles with a mean particle size of 0.005 microns in water at a concentration of 14.5% solids by weight.

***Nalcoag 1060 is a product of Nalco Chemical Company identified as dispersion of $SiO_2$ particles with a mean particle size of 0.060 microns in water at a concentration of 50% solids by weight.

The following Examples 48 to 50 are run under the same test conditions as the foregoing Examples 24 to 47 with the exception that the aqueous conversion coating solution is aged for 24 hours prior to coating any test panels.

| Example | Solution Contents | Component Concentration | pH of Solution | Corrosion Resistance |
|---|---|---|---|---|
| 48 | Concentrate No. 1 | 81 g/l | 2.0 | 90% at 24 hrs. |
| | Nalcoag 2326 | 72.4 g/l | | |
| 49 | Concentrate No. 2 | 81 g/l | 2.0 | 88% at 24 hrs. |
| | Cab-O-Grip II | 52.5 g/l | | |
| | Chromate Blue No. 1 | 0.1 g/l | | |
| 50 | Concentrate No. 2 | 81 g/l | 2.0 | 94% at 24 hrs. |
| | Cab-O-Grip II | 52.5 g/l | | |
| | Chromate Black No. 1 | 0.3 g/l | | |

The following Examples 51 to 54 are run under the same conditions as the foregoing Examples 24 to 47 with the exception that the panels are dried at a temperature of about 150° C. for 5 minutes, rather than at room temperature.

| Example | Solution Contents | Component Concentration | pH of Solution | Corrosion Resistance |
|---|---|---|---|---|
| 51 | Concentrate No. 1 | 81 g/l | 2.0 | 91% at 24 hrs. |
| | Nalcoag 2326 | 72.4 g/l | | |
| 52 | Concentrate No. 1 | 81 g/l | 2.0 | 82% at 24 hrs. |
| | Cab-O-Grip II | 52.5 g/l | | |
| 53 | Concentrate No. 1 | 81 g/l | 2.0 | 88% at 24 hrs. |
| | Nalcoag 1060 | 26.3 g/l | | |
| 54 | Concentrate No. 1 | 81 g/l | 2.0 | 85% at 24 hrs. |
| | Nalcoag 1060 | 21.0 g/l | | |

The following Examples 55 to 64 are run under the same conditions as Examples 24 to 47 with the exception that the panels are immersed in the conversion coating solution for about 45 seconds, rather than 15 to 30 seconds, and then dried at a temperature of about 150° C. for two minutes, rather than at room temperature.

| Example | Solution Contents | Component Concentration | pH of Solution | Corrosion Resistance |
|---|---|---|---|---|
| 55 | Concentrate No. 1 | 81 g/l | 1.0 | 88% at 24 hrs. |
| 56 | Concentrate No. 1 | 81 g/l | 1.5 | 95% at 24 hrs. |
| 57 | Concentrate No. 1 | 81 g/l | 2.0 | 82% at 24 hrs. |
| 58 | Concentrate No. 1 | 81 g/l | 2.5 | 76% at 24 hrs. |
| 59 | Concentrate No. 2 | 81 g/l | 1.0 | 79% at 24 hrs. |
| 60 | Concentrate No. 2 | 81 g/l | 1.5 | 79% at 24 hrs. |
| 61 | Concentrate No. 2 | 81 g/l | 2.0 | 94% at 24 hrs. |
| 62 | Concentrate No. 2 | 81 g/l | 2.5 | 95% at 24 hrs. |
| 63 | Concentrate No. 2 | 81 g/l | 3.0 | 97% at 24 hrs. |
| 64 | Concentrate No. 2 | 81 g/l | 3.5 | 94% at 24 hrs. |

The following Examples 65 to 76 are run under the same conditions as the foregoing Examples 24 to 47 with the exception that panels are immersed in the conversion coating solution for about 45 seconds, rather than 15 to 30 seconds, and then dried at a temperature of about 150° C. for five minutes, rather than at room temperature.

| Example | Solution Contents | Component Concentration | pH of Solution | Corrosion Resistance |
|---|---|---|---|---|
| 65 | Concentrate No. 1 | 81 g/l | 1.0 | 82% at 24 hrs. |
| | Cab-O-Grip II | 10 g/l | | |
| 66 | Concentrate No. 1 | 81 g/l | 1.5 | 97% at 24 hrs. |
| | Cab-O-Grip II | 10 g/l | | |
| 67 | Concentrate No. 1 | 81 g/l | 2.0 | 88% at 24 hrs. |
| | Cab-O-Grip II | 10 g/l | | |
| 68 | Concentrate No. 1 | 81 g/l | 2.5 | 76% at 24 hrs. |
| | Cab-O-Grip II | 10 g/l | | |
| 69 | Concentrate No. 1 | 81 g/l | 3.0 | 82% at 24 hrs. |
| | Cab-O-Grip II | 10 g/l | | |
| 70 | Concentrate No. 1 | 81 g/l | 3.5 | 85% at 24 hrs. |
| | Cab-O-Grip II | 10 g/l | | |
| 71 | Concentrate No. 1 | 81 g/l | 4.0 | 85% at 24 hrs. |
| | Cab-O-Grip II | 10 g/l | | |
| 72 | Concentrate No. 2 | 81 g/l | 1.5 | 82% at 24 hrs. |
| | Cab-O-Grip II | 10 g/l | | |
| 73 | Concentrate No. 2 | 81 g/l | 2.0 | 94% at 24 hrs. |
| | Cab-O-Grip II | 10 g/l | | |
| 74 | Concentrate No. 2 | 81 g/l | 2.5 | 97% at 24 hrs. |
| | Cab-O-Grip II | 10 g/l | | |
| 75 | Concentrate No. 2 | 81 g/l | 3.0 | 100% at 24 hrs. |
| | Cab-O-Grip II | 10 g/l | | |
| 76 | Concentrate No. 2 | 81 g/l | 3.5 | 85% at 24 hrs. |
| | Cab-O-Grip II | 10 g/l | | |

In the following Examples 77 to 90 ammonium nitrate, sodium nitrate or potassium nitrate are combined with Dequest 2010 to form the desired aqueous acidic conversion solution. Freshly plated zinc panels are immersed in an aqueous solution containing 2.5 mililiters per liter of 70% nitric acid for 10 seconds and then immersed in the indicated aqueous acidic coating solution for about 45 seconds whereupon a coating with a clear or white-blue appearance is formed. In each instance, an effective amount of nitric acid is added to the coating solution to obtain the indicated level of pH. The panels are removed from the solution, rinsed with water and dried at a temperature of about 150° C. for 5 minutes. The dried panels are subjected to a 5% neutral salt spray environment for the indicated number of hours with the results indicated as the percentage of surface area free of white rust measured by visual inspection.

| Example | Solution Contents | Component Concentration | pH of Solution | Corrosion Resistance |
|---|---|---|---|---|
| 77 | $NaNO_3$ | 5 g/l | 2.0 | 85% at 24 hrs. |
| | Dequest 2010 | 2.9 g/l | | |

-continued

| Example | Solution Contents | Component Concentration | pH of Solution | Corrosion Resistance |
|---|---|---|---|---|
| 78 | $KNO_3$ | 5 g/l | 2.0 | 85% at 24 hrs. |
| | Dequest 2010 | 2.9 g/l | | |
| 79 | $NH_4NO_3$ | 5 g/l | 2.0 | 88% at 24 hrs. |
| | Dequest 2010 | 2.9 g/l | | |
| 80 | $NaNO_3$ | 10 g/l | 2.0 | 91% at 24 hrs. |
| | Dequest 2010 | 2.9 g/l | | |
| 81 | $KNO_3$ | 10 g/l | 2.0 | 88% at 24 hrs. |
| | Dequest 2010 | 2.9 g/l | | |
| 82 | $NH_4NO_3$ | 10 g/l | 2.0 | 85% at 24 hrs. |
| | Dequest 2010 | 2.9 g/l | | |
| 83 | $NaNO_3$ | 20 g/l | 2.0 | 91% at 24 hrs. |
| | Dequest 2010 | 2.9 g/l | | |
| 84 | $KNO_3$ | 20 g/l | 2.0 | 85% at 24 hrs. |
| | Dequest 2010 | 2.9 g/l | | |
| 85 | $NH_4NO_3$ | 20 g/l | 2.0 | 85% at 24 hrs. |
| | Dequest 2010 | 2.9 g/l | | |
| 86 | $NaNO_3$ | 13.3 g/l | 3.0 | 85% at 24 hrs. |
| | Dequest 2010 | 2.2 g/l | | |
| 87 | $NaNO_3$ | 13.3 g/l | 3.0 | 91–94% at 24 hrs. |
| | Dequest 2010 | 2.2 g/l | | |
| | Cab-O-Grip II | 10.0 g/l | | |
| 88 | $KNO_3$ | 15.8 g/l | 3.0 | 91–94% at 24 hrs. |
| | Dequest 2010 | 2.2 g/l | | |
| 89 | $KNO_3$ | 15.8 g/l | 3.5 | 75% at 24 hrs. |
| | Dequest 2010 | 2.2 g/l | | |
| | Cab-O-Grip II | 10.0 g/l | | |
| 90 | $NH_4NO_3$ | 12.5 g/l | 4.0 | 88% at 24 hrs. |
| | Dequest 2010 | 2.2 g/l | | |

In the following Examples 91 to 109, $NaNO_3$, $Ca(NO_3)_2$, $Zn(NO_3)_2.6H_2O$, $NaBrO_3$, $H_2O_2$ or $NaNO_2$ are combined with Dequest 2010 to form the desired aqueous acidic conversion solution. Cab-O-Grip II is added at the indicated levels to some of the solutions (Examples 93, 94, 99, 100 and 103). Freshly plated zinc panels are immersed in an aqueous solution containing 2.5 mililiters per liter of 70% nitric acid for 10 seconds and then immersed in the indicated aqueous acidic coating solutions for about 45 seconds whereupon a coating with a clear or white-blue appearance is formed. In each instance, an effective amount of nitric acid is added to the coating solution to obtain the indicated level of pH. The panels are removed from the solution, rinsed with water, dried in air and then dried at a temperature of about 120° C. for 5 minutes. The dried panels are subjected to a 5% neutral salt spray environment for the indicated number of hours with the results indicated as the percentage of surface area free of white rust measured by visual inspection.

| Example | Solution Contents | Component Concentration | pH of Solution | Corrosion Resistance |
|---|---|---|---|---|
| 91 | $NaNO_3$ | 20 g/l | 1.9 | 90% at 24 hrs. |
| | Dequest 2010 | 10 g/l | | |
| 92 | $NaNO_3$ | 20 g/l | 1.8 | 80–85% at 24 hrs. |
| | Dequest 2010 | 12 g/l | | |
| 93 | $NaNO_3$ | 20 g/l | 1.9 | 85–90% at 24 hrs. |
| | Dequest 2010 | 10 g/l | | |
| | Cab-O-Grip II | 20 g/l | | |
| 94 | $NaNO_3$ | 20 g/l | 1.8 | 85–90% at 24 hrs. |
| | Dequest 2010 | 12 g/l | | |
| | Cab-O-Grip II | 20 g/l | | |
| 95 | $Ca(NO_3)_2$(80% sol'n.) | 5.1 g/l | 2.0 | 90% at 24 hrs. |
| | Dequest 2010 | 2 g/l | | |
| 96 | $Zn(NO_3)_2.6H_2O$ | 7.2 g/l | 1.9 | 90% at 24 hrs. |
| | Dequest 2010 | 2 g/l | | |
| 97 | $Ca(NO_3)_2$(80% sol'n.) | 10.2 g/l | 2.0 | 90–95% at 24 hrs. |
| | Dequest 2010 | 2 g/l | | |
| 98 | $Zn(NO_3)_2.6H_2O$ | 14.4 g/l | 1.9 | 90–95% at 24 hrs. |
| | Dequest 2010 | 2 g/l | | |
| 99 | $Ca(NO_3)_2$(80% sol'n.) | 10.2 g/l | 2.0 | 90% at 24 hrs. |

-continued

| Example | Solution Contents | Component Concentration | pH of Solution | Corrosion Resistance |
|---|---|---|---|---|
| | Dequest 2010 | 2 g/l | | |
| | Cab-O-Grip II | 20 g/l | | |
| 100 | $Zn(NO_3)_2.6H_2O$ | 14.4 g/l | 1.9 | 90% at 24 hrs. |
| | Dequest 2010 | 2 g/l | | |
| | Cab-O-Grip II | 20 g/l | | |
| 101 | $NaBrO_3$ | 9 g/l | 2.15 | 85-90% at 24 hrs. |
| | Dequest 2010 | 2.2 g/l | | |
| 102 | $NaBrO_3$ | 12 g/l | 2/1 | 85-90% at 24 hrs. |
| | Dequest 2010 | 2.2 g/l | | |
| 103 | $NaBrO_3$ | 12 g/l | 2.1 | 85-90% at 24 hrs. |
| | Dequest 2010 | 2.2 g/l | | |
| | Cab-O-Grip II | 20 g/l | | |
| 104 | $H_2O_2$ (35% sol'n.) | 1.0 ml/l | 2.2 | 85-90% at 24 hrs. |
| | Dequest 2010 | 2.2 g/l | | |
| 105 | $H_2O_2$ (35% sol'n.) | 1.5 ml/l | 2.15 | 85-90% at 24 hrs. |
| | Dequest 2010 | 2.2 g/l | | |
| 106 | $H_2O_2$ (35% sol'n.) | 2.0 ml/l | 2.1 | 85-90% at 24 hrs. |
| | Dequest 2010 | 2.2 g/l | | |
| 107 | $NaNO_2$ | 1 g/l | 2.3 | 65% at 24 hrs. |
| | Dequest 2010 | 2.2 g/l | | |
| 108 | $NaNO_2$ | 2 g/l | 3.0 | 95% at 24 hrs. |
| | Dequest 2010 | 2.2 g/l | | |
| 109 | $NaNO_2$ | 2 g/l | 3.8 | 90-95% at 24 hrs. |
| | Dequest 2010 | 2.2 g/l | | |

The following Examples 110 to 112 are run under the same conditions as Examples 91 to 109 with the exception that the solution is constituted of Concentrate No. 2, $NaHF_2$ and an effective amount of NaOH to obtain the indicated pH.

| Example | Solution Contents | Component Concentration | pH of Solution | Corrosion Resistance |
|---|---|---|---|---|
| 110 | Concentrate No. 2 | 81 g/l | 2.3 | 97-98% at 24 hrs. |
| | $NaHF_2$ | 1.5 g/l | | |
| 111 | Concentrate No. 2 | 81 g/l | 3.0 | 95% at 24 hrs. |
| | $NaHF_2$ | 1.5 g/l | | |
| 112 | Concentrate No. 2 | 81 g/l | 3.5 | 95% at 24 hrs. |
| | $NaHF_2$ | 1.5 g/l | | |

In the following Examples 113 to 117 sodium-meta-nitrobenzene sulfonate (SMNBS) is combined with Dequest 2010 to form the desired aqueous acidic conversion solution. Freshly plated zinc panels are immersed in an aqueous solution containing 2.5 mililiters per liter of 70% nitric acid for 10 seconds and then immersed in the indicated aqueous acidic coating solutions for about 45 seconds. In each instance, an effective amount of nitric acid is added to the coating solution to obtain the indicated level of pH. The panels are removed from the solution, rinsed with water, dried in air and dried at a temperature of about 120° C. for 5 minutes. In each instance a clear to light-blue coating is formed.

| Example | Solution Contents | Component Concentration | pH of Solution |
|---|---|---|---|
| 113 | SMNBS | 1 g/l | 2.3 |
| | Dequest 2010 | 2.2 g/l | |
| 114 | SMNBS | 2 g/l | 2.3 |
| | Dequest 2010 | 2.2 g/l | |
| 115 | SMNBS | 4 g/l | 2.3 |
| | Dequest 2010 | 2.2 g/l | |
| 116 | SMNBS | 8 g/l | 2.3 |
| | Dequest 2010 | 2.2 g/l | |
| 117 | SMNBS | 8 g/l | 3.0 |
| | Dequest 2010 | 2.2 g/l | |

In the following Examples 118 and 119, freshly plated cadmium panels are immersed in an aqueous solution containing 2.5 mililiters per liter of 70% nitric acid for 10 seconds and then immersed in the indicated aqueous acidic coating solution for 20 seconds whereupon the formation of a coating is observed. In each instance, an effective amount of nitric acid is added to the coating solution to obtain the indicated level of pH. The panels are removed from the solution, rinsed with water, dried in air and then dried at a temperature of about 120° C. for five minutes. Droplets of 5% lead acetate solution are deposited on the dried panels and the time for the portion of the panel in contact with lead acetate solution to turn black is observed.

| Example | Solution Contents | Concentration | Component Solution | pH of Black | Time to Turn |
|---|---|---|---|---|---|
| 118 | Concentration No. 2 | | 81 g/l | 2.25 | 5 seconds |
| 119 | Concentration No. 2 | | 81 g/l | 3.0 | 10 seconds |

The desirable results which are illustrated in the foregoing examples may be obtained with the coating solutions of this invention over all types of zinc or cadmium plate. Thus, the coating solutions of the invention are useful, for example, over zinc plates deposited by alkaline noncyanide type zinc plating solutions, alkaline cyanide zinc plating solutions and acid zinc solutions.

After a metal article has been treated in accordance with the method and composition of the invention, it often is preferred to apply an organic coating composition which may be a siccative coating such as paint, lacquer, varnish, synthetic resin, or enamel, or an electrostatically deposited powder coating. Examples of siccative coatings which may be used are the acrylic alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction. The coated article is dried in a manner best suited for the siccative coating composition employed such as by air drying at ambient or elevated temperatures, baking in an oven, or baking under infra-red lamps. In most instances, the thickness of the dried film with a siccative organic coating composition will be from about 0.1 to about 10 mils, and more often between 0.3 to about 5 mils.

From the above description, it will be apparent that the advantages which are obtained from this invention include the avoidance of chromium as a pollutant in the process effluent, ease of control since the need for addition of components can be determined by visual appearance of coated parts and/or measuring the pH, ability to use the same solution over almost all types of zinc or cadmium plate regardless of method of deposition, consistent reproducability of the finished appearance, good paint adhesion of the treated metal and good corrosion resistance. Additionally, the coating solution of the invention and the concentrates for preparing and/or maintaining the same are stable over a relatively indefinite period of time. Gels of the type observed in prior art solutions which form and float to the top and eventually take up a significant volume of container space are not observed in the solution or concentrates of the invention under normal operating conditions, making for facilitated procedures for preparing and/or maintaining the solutions and concentrates of the invention.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An aqueous acidic coating solution for treating zinc, zinc alloy or cadmium surface consisting essentially of water, an effective amount of nitric acid to provide a desired level acidity, and (A) an oxidizing agent selected from the group consisting of hydrogen peroxide, nitrate ion, nitrite ion, halate ion or mixtures thereof, and (B) a compound having the formula

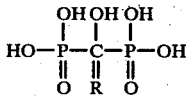

wherein R is hydrogen or an alkyl group of from 1 to 4 carbon atoms.

2. The solution of claim 1 wherein component (B) is 1-hydroxyethylidene-1,1-diphosphonic acid, said component (B) being present in said solution at a concentration in the range of about 0.5 to about 10 grams per liter.

3. The solution of claim 1 wherein component (A) is nitrate ion, said nitrate ion being present in said solution at a concentration in the range of about 1 to about 50 grams per liter.

4. The solution of claim 1 wherein component (A) is nitrite ion, said nitrite ion being present in said solution at a concentration in the range of about 0.5 to about 2 grams per liter.

5. The solution of claim 1 wherein component (A) is halate ion, said halate ion being present in said solution at a concentration in the range of about 0.5 to about 20 grams per liter.

6. The solution of claim 1 wherein component (A) is hydrogen peroxide, said hydrogen peroxide being present in said solution at a level in the range of about 0.5 to about 20 grams per liter.

7. The solution of claim 1 wherein component (A) is nitrate ion, said nitrate ion comprising the anionic portion of a salt selected from the group consisting of aluminum nitrate, alkali metal nitrate, alkaline-earth metal nitrate, zinc nitrate or ammonium nitrate.

8. The solution of claim 1 wherein component (A) is nitrite ion, said nitrite ion comprising the anionic portion of alkali metal nitrite.

9. The solution of claim 1 wherein component (A) is halate ion, said halate ion comprising the anionic portion of alkali metal halate.

10. The solution of claim 1 wherein component (A) is nitrate ion, said nitrate ion being present in said solution in the form of aluminum nitrate at a concentration in the range of between about 0.5 and about 70 grams per liter.

11. The solution of claim 10 wherein said aluminum nitrate is in said solution at a concentration in the range of between about 7.5 and 15 grams per liter.

12. The solution of claim 1 wherein component (A) is nitrate ion, said nitrate ion being present in said solution in the form of sodium nitrate or potassium nitrate at a concentration in the range of between about 1 and about 50 grams per liter.

13. The solution of claim 12 wherein said sodium nitrate or potassium nitrate is present in said solution at a concentration in the range of between about 5 and about 15 grams per liter.

14. The solution of claim 1 wherein component (A) is nitrate ion, said nitrate ion being present in said solution in the form of a mixture of aluminum nitrate and sodium nitrate, said aluminum nitrate being present in said solution at a concentration level of between about 0.5 and about 70 grams per liter, said sodium nitrate being present in said solution at a concentration in the range of about 1 to about 50 grams per liter.

15. The solution of claim 1 with an effective amount of a conversion coating dye to impart a desired color to said surface.

16. The solution of claim 1 with an effective amount of nitric acid to provide a pH for said solution in the range of about 1 to about 4.

17. An aqueous acidic concentrate for preparing or maintaining the solution of claim 1 comprising components (A) and (B).

18. The concentrate of claim 17 wherein component (A) comprises nitrate ion.

19. The concentrate of claim 17 wherein component (B) comprises-1-hydroxyethylidene-1,1-diphosphonic acid.

20. The concentrate of any of claims 17, 18 or 19 including sodium bifluoride.

21. The concentrate of any of claims 17, 18 or 19 including nitric acid.

22. An aqueous acidic conversion coating solution for treating zinc, zinc alloy or cadmium surface consisting essentially of: water, from about 0.5 to about 70 grams per liter of aluminum nitrate; from about 0.5 to about 10 grams per liter of 1-hydroxyethylidene-1,1-diphosphonic acid; and an effective amount of nitric acid to provide a pH for said solution of between about 1 and about 4.

23. An aqueous acidic coating solution for treating zinc, zinc alloy or cadmium surface consisting essentially of: water; from about 1 to about 50 grams per liter of sodium nitrate or potassium nitrate; from about 0.5 to about 10 grams per liter of 1-hydroxyethylidene-1,1-diphosphonic acid; and an effective amount of nitric acid to provide a pH for said solution between about 1 and about 4.

24. An aqueous acid coating solution for treating zinc, zinc alloy or cadmium surface consisting essentially of: water; from about 0.5 to about 70 grams per liter of aluminum nitrate; from about 1 to about 50 grams per liter of sodium nitrate or potassium nitrate; from about 0.5 to about 10 grams per liter of 1-hydroxyethylidene-1,1-diphosphonic acid; and an effective amount of nitric acid to provide a pH for said solution in the range of about 1 to about 4.

25. An aqueous acidic coating solution for treating zinc, zinc alloy or cadmium surface consisting essentially of water, nitrobenzene sulfonate and an organophosphorous compound having the formula

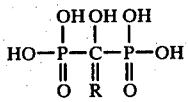

wherein R is hydrogen or an alkyl group of from 1 to 4 carbon atoms.

26. The solution of claim 25 wherein said sulfonate is sodium m-nitrobenzene sulfonate.

27. The solution of claim 25 wherein said organophosphorous compound is 1-hydroxyethylidene-1,1-diphosphonic acid.

28. A method of producing a conversion coating on zinc, zinc alloy or cadmium surface which comprises contacting said surface with an aqueous acidic solution of any of claims 1, 2, 24 or 25-27.

29. The method of claim 25 wherein the solution is applied to said surface at a temperature in the range of about 10° C. to about 50° C. for about 15 seconds to about 1 minute.

30. An article having a zinc, zinc alloy or cadmium surface treated with the aqueous acidic solution of any of claims, 1, 2 24 or 25-27.

31. An aqueous acidic concentrate for preparing or replenishing an aqueous acidic coating solution comprising a total weight of about 100 parts by weight, about 8.5 said parts being aluminum nitrate nonahydrate, about 1.5 of said parts being 1-hyroxyethylidene-1,1-diphosphonic acid, about 7 of said parts being nitric acid, the remainder consisting essentially of water.

32. An aqueous acidic concentrate for preparing or replenishing an aqueous acidic coating solution comprising a total weight of about 100 parts by weight, about 5.7 of said parts being sodium nitrate, about 1.5 of said parts being 1-hydroxyethylidene-1,1-diphosphonic acid, about 7 of said parts being nitric acid, the remainder consisting essentially of water.

33. An aqueous acid concentrate for preparing or replenishing an aqueous acidic coating solution comprising a total weight of about 100 parts by weight, about 11.4 of said parts being sodium nitrate, about 3 of said parts being 1-hydroxyethylidene-1,1-diphosphonic acid, about 14 of said parts being nitric acid, about 3 of said parts being sodium bifluoride, the remainder consisting essentially of water.

34. An aqueous acidic coating solution for treating zinc, zinc alloy or cadmium surface consisting essentially of about 1 part by volume of the concentrate of claims 31, 32 or 33 and about 24 parts by volume of water.

* * * * *